US006071086A

United States Patent [19]

Thoma

[11] Patent Number: 6,071,086

[45] Date of Patent: Jun. 6, 2000

[54] RADIAL PISTON HYDROSTATIC MACHINE WITH A FIRST SWEEPING-DISPLACEMENT STAGE ABOUT THE ROTATION OF A PISTON CYLINDER-BARREL FLUIDLY CONNECTED TO A SECOND FLUID DISPLACEMENT STAGE WITHIN THE PISTONS

[75] Inventor: Christian Helmut Thoma, Jersey, United Kingdom

[73] Assignee: Unipat Aktiengessellschaft, Glarus, Switzerland

[21] Appl. No.: 08/989,663

[22] Filed: Dec. 12, 1997

[30] Foreign Application Priority Data

Dec. 17, 1996 [GB] United Kingdom ..... 9626175
Jul. 14, 1997 [GB] United Kingdom ..... 9714752

[51] Int. Cl.[7] ..... F04B 1/04

[52] U.S. Cl. ..... 417/273

[58] Field of Search ..... 417/273, 219, 417/205, 251; 92/72

[56] References Cited

U.S. PATENT DOCUMENTS

| | | | |
|---|---|---|---|
| 2,105,454 | 1/1938 | Ferris . | |
| 2,818,707 | 1/1958 | Sturm | 60/53 |
| 3,010,405 | 11/1961 | Tomell . | |
| 4,505,652 | 3/1985 | Burgdorf et al. | 417/462 |
| 4,555,223 | 11/1985 | Budecker et al. | 417/462 |
| 4,686,829 | 8/1987 | Thoma et al. | 60/464 |
| 4,975,025 | 12/1990 | Yamamura et al. | 417/273 |
| 5,046,931 | 9/1991 | Runkle | 417/463 |
| 5,482,442 | 1/1996 | Blair et al. | 417/220 |
| 5,626,465 | 5/1997 | Thoma | 417/273 |

FOREIGN PATENT DOCUMENTS

| | | |
|---|---|---|
| 524384 | 8/1940 | United Kingdom . |
| 1 465 876 | 3/1977 | United Kingdom . |

*Primary Examiner*—Charles G. Freay
*Assistant Examiner*—Robert Z. Evora
*Attorney, Agent, or Firm*—Young & Thompson

[57] ABSTRACT

A radial piston hydrostatic machine having a first fluid displacement stage and a second fluid displacement stage, the machine having an outer housing structure for defining an internal chamber, a drive-shaft supported in the housing and operatively connected to a cylinder-barrel located within the internal chamber, the cylinder-barrel having a number of radial cylinders and each cylinder containing a piston operatively connected to a surrounding annular track-ring, the cylinder-barrel and pistons defining a rotating-group and where the rotating-group is positioned in a sub-chamber generally defined axially by the width of the track-ring and radially by the radial distance between the cylinder-barrel and surrounding track-ring. The volume space between adjacent pistons defined as cells and fluid distribution means in the housing comprising two or more ducts lying axially adjacent the rotating-group and generally radially inwards of said track-ring to communicate with the sub-chamber to provide a first stage pumping motion when the track-ring is eccentric in position in relation to the cylinder-barrel in order to "prime" the second stage piston reciprocating assembly in the cylinder-barrel. The invention further allows more than one hydrostatic machine to be driven by the same drive-shaft whereby the drive-shaft can be extended to pass through the machine without problems arising because the low-pressure fluid passages are restricted in size.

33 Claims, 11 Drawing Sheets

RADIAL PISTON HYDROSTATIC MACHINE WITH A FIRST SWEEPING-DISPLACEMENT STAGE ABOUT THE ROTATION OF A PISTON CYLINDER-BARREL FLUIDLY CONNECTED TO A SECOND FLUID DISPLACEMENT STAGE WITHIN THE PISTONS

BACKGROUND OF THE INVENTION

This invention relates to positive displacement rotary reciprocating piston machines of the type where the displacement of a piston within a cylinder causes fluid to be displaced within that cylinder.

For purposes of definition, a hydrostatic piston machine of the radial piston variety can either be of the type where a shaft-driven cylinder-barrel is mounted for rotation on a ported pintle-valve as disclosed in Ferris U.S. Pat. No. 2,105,454 or where the cylinder barrel is mounted for rotation on a revolving shaft. In the second type, a stationary axial distributor face valve is used in place of the pintle-valve and where a pair of kidney-shaped channels are used to fluidly connect with the cylinder-barrel to act as the means for porting the individual cylinders in the manner as shown in Tomell) U.S. Pat. No. 3,010,405.

In the first type of radial piston machine employing a pintle-valve, the cylinder-barrel is mounted for rotation about the longitudinal axis of the pintle-valve, and where the cylinder-barrel is provided with a series of cylinders. Each cylinder contains a piston and each piston is operatively connected to a surrounding annular track-ring. When the track-ring is positioned eccentric with respect to the cylinder-barrel, reciprocation of the pistons within their cylinders occurs. The arcuate-slots provided on the periphery of the pintle-valve and arranged to communicate through a series of fluid-passages which connect with fluid inlet and outlet conduits attached to the exterior of the housing of the machine. In the case of a hydraulic pump, rotary movement of the cylinder-barrel when the surrounding track-ring is eccentrically positioned, causes radial displacement of the pistons and a corresponding displacement of fluid from the "low-pressure" inlet conduit to the "higher-pressure" outlet conduit. The control-system of the machine determines the amount of track-ring eccentricity required in order that the resulting piston stroke is sufficient to meet the demands of a hydraulic system or circuit which the machine serves. In the case of an axial distributor face valve type of radial piston machine, kidney-shaped channels are used in place of such arcuate-slots, and where such kidney-shaped channels are formed on the axial distributor face valve which are arranged to fluidly connect with the cylinders provided in the rotatable cylinder-barrel.

Pintle-valves are thus well known and have been used in the art of radial piston machines for many decades. However, one constraint of using a pintle-valve is that only having a relatively small space is available within the pintle-valve for the inclusion of the necessary fluid-passages in order not to compromise the mechanical strength of the pintle-valve. In modern designs, this can be a problem as the pintle-valve is loaded in cantilever fashion by the radial forces emanating from the pressurized pistons. Therefore, such pintle-valve machines require careful application, especially when operated under certain conditions such as high-speed and in cold environments, in order to minimize the possibility of cavitation occurring in the relatively small fluid-passages in the pintle-valve. As a result, it is common practice to boost the inlet of such pintle-valve machines, usually by means of using a separate charge or boost pump.

A prior attempt for minimising the chances of cavitation occurring in the relatively small fluid-passages in the pintle-valve is shown in Great Britain Patent No. 524,384. In this pump, the fluid entering the space surrounding the rotating elements is propelled radially outwardly by centrifugal action, the centrifugally impelled fluid being arranged to pass through a diffuser passage provided in the track-ring from where it is piped to the low-pressure fluid passage in the pintle-valve. The disadvantage, however, is that the diffuser passage in the track-ring substantially weakens the strength of the track-ring. As a result, this pump is only suitable for relatively low-pressure applications or limited in the sense that the diameter of the pistons must be relatively small in size in order to avoid the track-ring becoming subjected to loads that could either cause the track-ring to deform or break due to the inherent weakness caused by the necessary addition of this diffuser passage. A new solution is therefore needed that does not compromise the strength of the track-ring or limit the unit to relatively low-pressure working applications.

It is also known practice to extend the drive-shaft of the radial piston machine axially in order that a further and separate hydraulic machine may be driven in the so-called "tandem" or "back-back" fashion. An example is shown in British Patent No. 1,465,876. This drive connection which passes through the centre of the radial piston machine, here called the first hydrostatic machine, maybe either in the form of a longitudinal extension to the drive-shaft or where a separate quill shaft is used in combination with the drive-shaft. In either case, for the purposes of further explanation, this drive connection will be referred to as a through-shaft. The need to include such a through-shaft for driving a second hydrostatic machine causes further difficulties because the low pressure fluid-passage in the pintle-valve of the first radial piston machine has to be restricted in size to allow space for the inclusion of a central longitudinal aperture in the pintle-valve in which the through-shaft passes. As the diameter of the pintle-valve is determined by various design parameters such as the generated area for the hydrostatic bearing field for enabling the piston loads to be supported, it is normally not possible to just exaggerate the size of the pintle-valve to provide more internal space for the fluid-passages and aperture. As such, the additional space required within the pintle-valve for the aperture through which the through-shaft passes means that the cross-sectional area of the low-pressure fluid-passage has to be arranged even smaller then would be normally the case if the requirement to drive a second hydrostatic machine were not needed. Having therefore to reduce the size of the suction or low-pressure fluid-passage in the pintle-valve in order to meet the requirement to drive the second hydrostatic machine accordingly may fisher increase the chances of cavitation occurring.

The addition of a separate "boost" pump, here called the third hydrostatic machine, into the circuit that acts to keep the first hydrostatic machine fully "primed" with fluid regardless of its operating conditions is the current practice, but this is not only costly to perform but further complicates matters because most often, the ideal location to mount and drive such a "boost" pump to the back of the second hydrostatic machine. Having to include a sufficiently large through-shaft in the first hydrostatic machine that can carry the driving torque required by both the second and third hydrostatic machines means in practice, that the space available within the pintle-valve for the fluid-passages is further reduced. Unless the through-shaft used is sufficiently large, is unlikely to have the required strength to be able to transmit the full driving torque that the second and third machines may demand on occasion. There therefore is a problem with current radial piston machines design employing pintle-valves.

By contrast, the size of fluid-passages used in an axial distributor face valve type of radial piston machine are not restricted in size even when a relatively large through-shaft is needed for driving further hydrostatic machines because the radial location of such passages and their corresponding kidney-shaped channels is at a greater pitch circle diameter than is possible with the pintle-valve type of radial piston machine. However, during cold weather operations at high speeds, cavitation may still occur, because the fluid passages in the cylinder-barrel that connect the cylinders to the kidney-shaped channels in the axial distributor face valve are rather small in cross-sectional area. Consequently, a separate "boost" pump may be required to boost the inlet of the first hydrostatic machine There therefore is also a need to provide an improved fluid circuit for the axial distributor face valve type of radial piston machine in order to eliminate the need of having to fit a third hydrostatic machine for such boosting purposes.

A further problem exists when the first hydrostatic machine, irrespective of whether it is uses a pintle-valve or axial distributor face valve, is driven for long periods at zero or minimal fluid output. Under such operating conditions, the heat generated inside the machine from hydro-mechanical losses may not be expelled sufficiently quickly into the connecting hydraulic fluid circuit. Overheating causes elements such as the seals to fail reducing the useful working life of the hydrostatic machine.

There is therefore a need in the art for a new radial piston hydrostatic machine that overcomes these known disadvantages of the prior art types.

BRIEF SUMMARY OF THE INVENTION

The invention, in one form thereof, relates to a radial piston hydrostatic machine having a first fluid displacement stage and a second fluid displacement stage and comprising a housing defining an internal chamber, a rotatable cylinder-barrel located within said internal chamber and provided with a series of cylinders each containing a piston, the reciprocating action of the pistons within said cylinders acting as said second fluid displacement stage; an annular track-ring surrounding said cylinder-barrel and having an inner track-surface on which said pistons are operatively connected to, said track-ring dividing said internal chamber into a main chamber and a sub-chamber and where the volume space radially outwards of said track-ring is said main chamber and the volume space radially inwards of said track-surface is said sub-chamber; said cylinder-barrel containing said pistons act in unison as the rotating-group of said machine and where fluid distribution means comprising first and second ducts are provided in said housing and arranged to open axially adjacent said rotating-group and generally radially inwards of said track-surface for communication with said sub-chamber, and where said rotating-group operating within said sub-chamber acts as said first fluid displacement stage for transferring fluid between said first and second ducts to the said second fluid displacement stage.

It is an object of the present invention to improve the "suction" characteristics of the hydrostatic radial piston machine without having to employ a separately mounted "boost" pump. This can be best achieved by way of utilizing the rotating cylinder-barrel assembly, here called the rotating-group or rotating-unit operating within the internal chamber of the machine for "supercharging" the fluid contained therein to be induced into entering a duct leading to the suction or low-passage provided in the pintle-valve or axial distributor face valve.

This is best performed by using the track-ring to divide the internal chamber of the machine into a main chamber and a sub-chamber, the main chamber being defined as the space in the machine surrounding the track-ring and rotating-group and the sub-chamber being defined as the space inside the track-ring where the rotating-group is positioned. The pistons (and slippers when used) with the cylinder-barrel operating within the sub-chamber act in unison as the rotating-group of the machine and where ducts are provided in the housing to be located axially adjacent to the rotating-group such that the cylinder-barrel is in a spaced relationship with the ducts thus avoiding any direct contact. These ducts being positioned generally radially outwardly from the radial length of the cylinder-barrel and generally radially inwards from the outer radial length of the annular track-ring such that the ducts can communicate with the sub-chamber.

The space or volume existing between adjacent pistons (and slippers when used) within the sub-chamber for purposes of definition are called cells -and where the cells form part of the first fluid displacement stage of the machine whereas the pistons in their cylinders provide the second fluid displacement stage. The space of volume of such cells between adjacent pistons being uniform during periods of machine operation when the track-ring is positioned concentric in relation to the cylinder-barrel, and during this condition, fluid in the cells is not transferred to the second fluid displacement stage. The fluid contained within the sub-chamber at this time circulates with the revolving rotating-group or preferably, a proportion is allowed to escape from the confines of the sub-chamber by means of a further duct or passage so that heat can be extracted from the machine.

Once the track-ring is moved by the control-system to be in an eccentric relationship with the cylinder-barrel, the pistons commence reciprocation and displace fluid within the cylinders. At the same instant, the volume of fluid within each of the cells of the first fluid displacement stage is no longer uniform but increases during one-half of the cycle of revolution of the rotating-group and then decreases during the remaining half cycle. As such, during the first half cycle when the cells expand in volume, fluid is drawn into these cells from one of the ducts in the housing, and the pistons (and their associated slippers when used) act in sweeping the fluid caught in these cells around the sub-chamber. As soon as the cells begins to contract in volume one the second half cycle starts, the fluid in the cells is expelled into the other duct. Therefore, during this mode of operation, the cells of the second fluid displacement stage change in volume twice during one full rotation of the cylinder-barrel, and in this manner, the first fluid displacement stage acts to prime or supercharge the second fluid displacement stage as soon as the pistons of the second fluid displacement stage begin to reciprocate within their cylinders.

It is therefore another aspect of the invention that the eccentric relationship between the track-ring and the cylinder-barrel promotes this supercharging effect.

A further feature of this invention is that the reciprocating working piston elements of the second fluid displacement stage and their associated component are prevented from overheating while at all times being copiously lubricated.

Apart from the necessary fluid passages in the housing required to allow fluid to enter and exit the machine, the housing is hermetically closed.

A still further feature of the invention is that it is one function of the rotating-group is to provide paddling means in the form of an impeller for the first fluid displacement stage while it is also another function of the rotating-group to provide the means whereby piston reciprocation within the cylinders occurs for the second fluid displacement stage. The rotating-group acts in effect as an impeller unit operating within a sub-chamber such that fluid is displaced both by the rotating motion as well as by the expansion and contraction of individual cells to provide the low-pressure stage whereas the piston to cylinder reciprocation provides the high-pressure stage.

So not to compromise the strength of the track-ring or to limit the pressure rating of this hydrostatic machine, the annular track-ring according to the invention has a solid interior and where the inner track-surface is uniform in form across its width over the entire circumferential length on which said pistons are operatively connected to. In effect, the track-surface may be said to define the outer perimeter of the first displacement stage whereas the cylinder-barrel may be said to define the inner perimeter of the first displacement stage.

A still further feature of the invention promotes adjacent housing walls to both side of said track-ring and the internally disposed rotating-group to be in close proximity in a sealed or semi-sealed manner thereby segregating or substantially segregating the sub-chamber from said internal chamber in a manner whereby a generous proportion of fluid entering the sub-chamber from one of the ducts can be propelled circumferentially to the other duct when fluid is demanded by the second stage. Preferably the fluid output of the first stage is so designed and arranged for a given effective running speed that its rate of injection of fluid exceeds the maximum potential fluid demanded by the second stage, and where excess fluid displaced by the first stage but not required by the second stage can be released from the sub-chamber.

According to the invention in another aspect, the suction or "low-pressure" fluid-passage in the pintle-valve can be sized smaller in diameter than would be normally required in a self-aspirated machine. According to another feature of the invention, the addition of slippers to each respective piston provides alternative means for drawing fluid into the cylinders from said sub-chamber.

According to a further aspect of the invention, a relatively large central aperture can be incorporated in the pintle-valve for the purpose of providing a through-shaft for coupling a second hydrostatic machine to the back of the first hydrostatic machine.

BRIEF DESCRIPTION OF THE DRAWINGS

The invention may be performed in various ways and specific embodiments over the conventional art are now described by way of examples with reference to the accompanying drawings, in which.

DETAILED DESCRIPTION OF THE INVENTION

Figure 1:
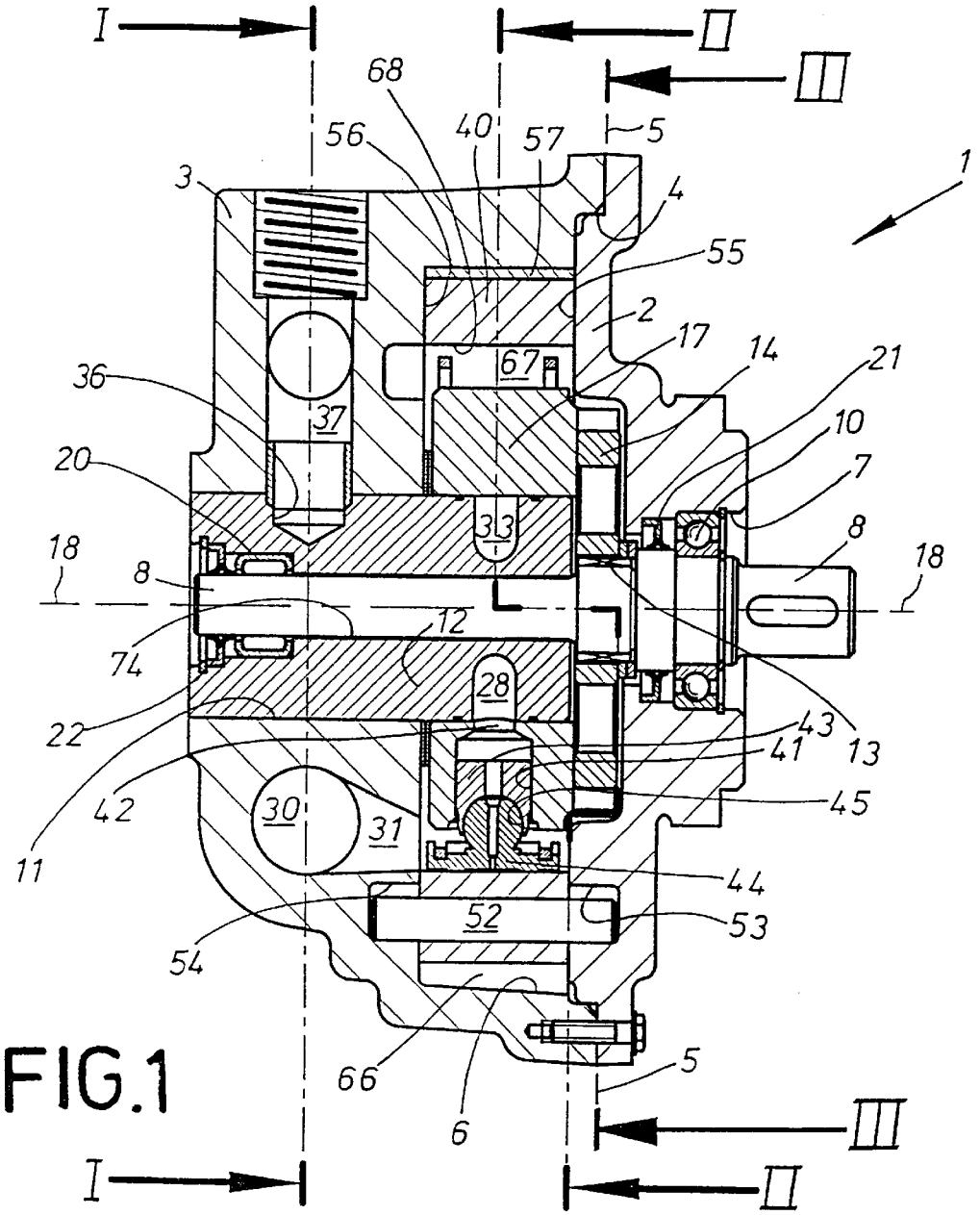
FIG. 1 is a side view of a hydrostatic radial piston machine according to the invention of the type employing a pintle-valve.

FIGS. 1 to 6 show a hydrostatic machine 1 having a housing comprising housing elements 2, 3 which fit together on a register 4 along a parting-plane 5 arranged between them to define an internal chamber 6. Housing element 2 is provided with a central aperture 7 into which a rotary drive-shaft 8 is supported by means of bearing 10, and where housing element 3 is provided with a central aperture 11 into which pintle-valve 12 is fixedly supported.

Drive-shaft 8 is connected by spline 13 to coupling 14 and coupling fits into slot 15 provided on the end face 16 of the cylinder-barrel 17. The drive-shaft 8 and cylinder-barrel 17 rotate about an axis shown as 18. Shaft 8 may be extended axially if desired, to past coupling 14 to be further supported by bearing positioned within pintle-valve 12, and although not shown, shaft 8 may protrude past housing element 3 to provide a drive connection if a further pump or second hydrostatic machine is to be attached to the back of the hydrostatic machine 1. Rotary seals 21, 22 for shaft 8 are provided in order to seal internal chamber 6 from the surroundings of the machine 1. For some applications it may be preferred to keep drive shaft 8 as short as possible, and in that case a separate quill shaft can be used to connect the machine 1 to a second hydrostatic machine or pump, the quill shaft being connected to drive shaft 8 in the neighbourhood of coupling 14 by means of a further spline or key.

Figure 2:
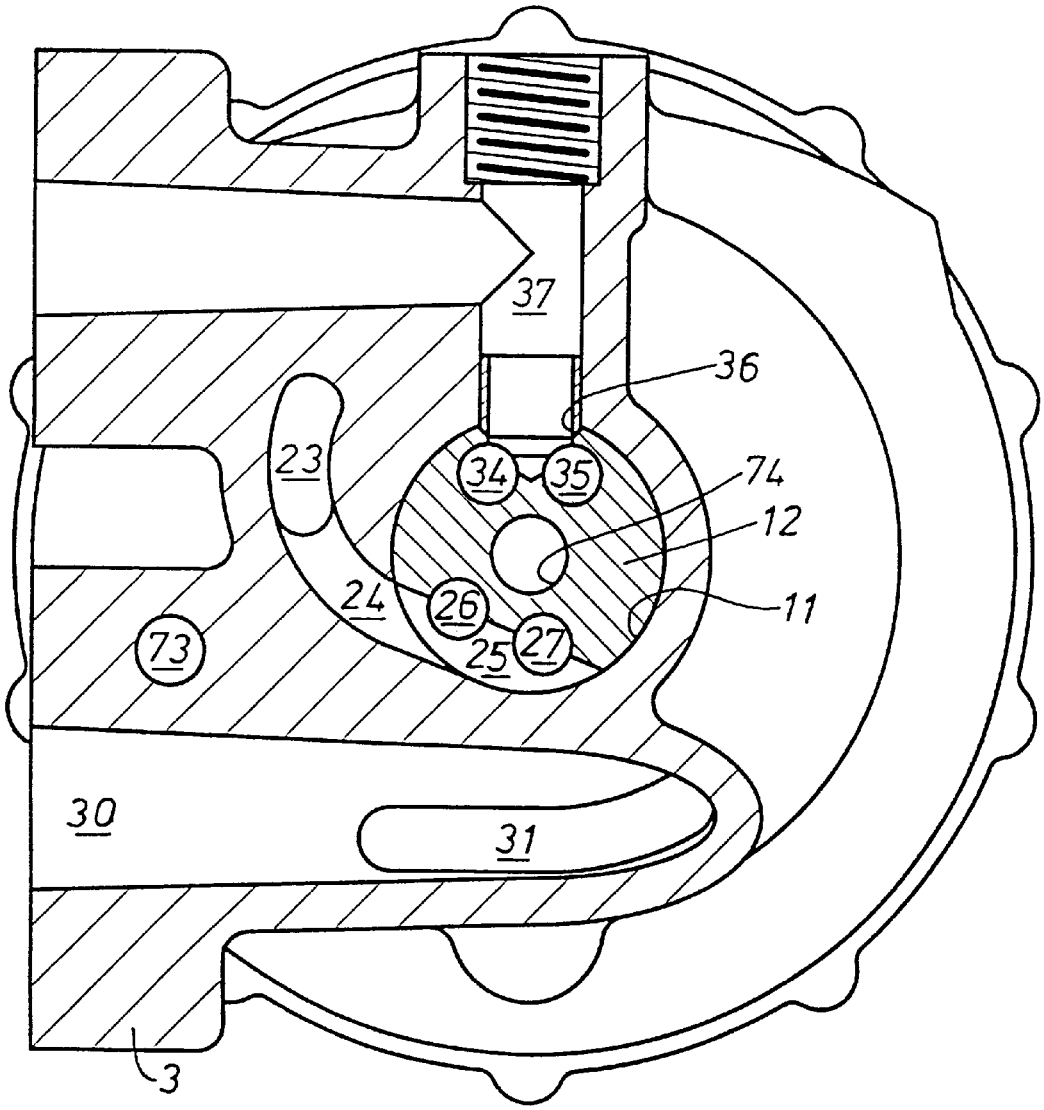
FIG. 2 is a sectional end view on line I—I of FIG. 1.

As shown in FIG. 2, duct 23 is provided in housing element 3 and arranged to connect by passage 24 to slot 25 provided in the pintle-valve 12. Fluid entering slot 25 via passage 24 then can pass into the two longitudinal passages 26, 27 in the pintle-valve 12 which are connected to an arcuate-slot shown as 28.

Fluid enters the hydrostatic machine 1 through fluid admittance passageway 30 and passes through the interior of housing element 3 to reach duct 31. A further duct shown as 32 is also provided.

The pintle-valve 12 is provided with a further arcuate-slot 33 which connects with longitudinal-passages 34, 35 in the pintle-valve 12 that lead to radial opening 36. Opening 36 in pintle-valve 12 is fluidly connected to the fluid discharge passageway 37 in housing element 3.

Fluid on entering the machine 1 is therefore first directed by duct 31 into the interior chamber of the machine 1 before passing through duct 23 and passage 24 to serve longitudinal passages 26, 27 in pintle-valve 12. As better seen in FIG. 4, the approximate pitch circle diameters on which respective ducts 23, 31 lie are arranged to be generally radially outward of the diameter of the cylinder-barrel 17 and generally radially inward of the outer diameter of an annular track-ring 40 that surrounds the cylinder-barrel 17.

As the embodiment here illustrated is the pintle-valve type of radial piston machine, cylinder-barrel 17 is supported for rotation by pintle-valve 12 and includes a number of cylinders 41 each connected through a respective "necked" cylinder-port 42 to allow fluid distribution between each of the cylinders 41 and the respective pair of arcuate-slots 28, 33 formed on the periphery of the pintle-valve 12.

Each cylinder 41 contains a piston 43 which is attached to a respective slipper 44 by means of a ball and socket joint shown as 45. When the slippers 44 are of the hydrostatic bearing type, they each are provided with a sealing lip shown as 46, and where central holes 47, 48 in the piston 43 and slipper 44 respectively allow high-pressure fluid within the cylinder 41 to reach a recess 50 formed inside the surrounding sealing lip 46 in a manner already well established in the art.

The track-ringer 40 is provided with a hole 51 into which is fitted a location-pin 52, the location-pin 52 being extended to protrude from the hole 51 in order that both its ends are engaged to respective slots 53, 54 provided in housing elements 2, 3. Track-ring 40 is disposed within internal chamber 6 and lies between interior housing walls shown as 55, 56.

Abutment means 57 are used to resist the radial movement of the track-ring 40 caused by the urge from those pistons 43 experiencing fluid under pressure at any one time, and a more detailed description of such abutment means can be found in U.S. Pat. No. 5,651,301. However, this invention may also be usefully used with the alternative track-ring types shown in Tomell in U.S. Pat. No. 3,010,405 or in Ferris U.S. Pat. No. 2,105,454.

By way of example, the eccentric movement of the track-ring 40 relative to the rotating axis 18 of cylinder-barrel 17 is shown in these embodiments, to use a mechanical adjustment means comprising a strut-member 58 having one or more laminations, and where the strut-member 58 is positioned to be to one side of track-ring 40 and adjacent to a peripheral wall shown as 60 of housing element 3.

Figure 3:
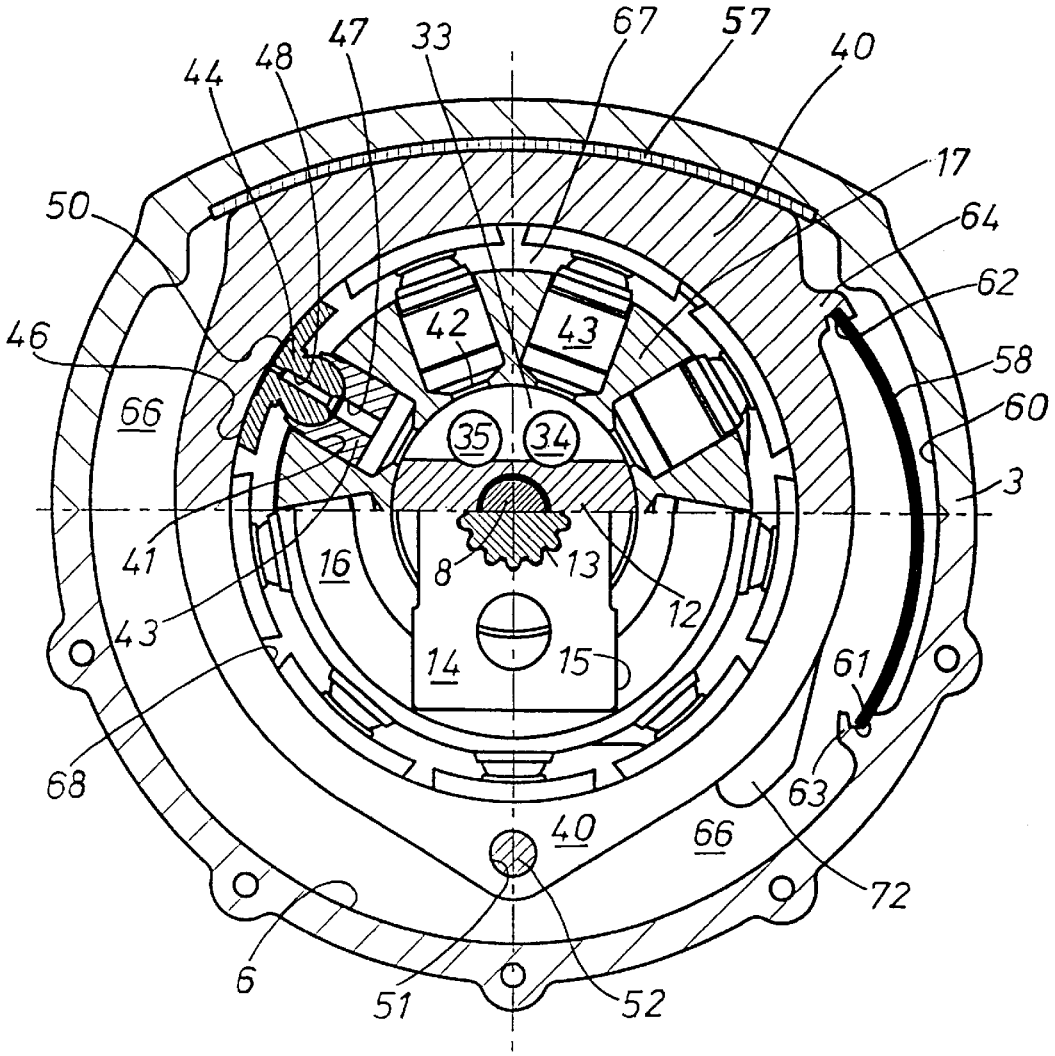
FIG. 3 is a sectional end view on line II—II of FIG. 1, and where the strut member as shown in its fully deformed condition which corresponds to the track-ring being in a concentric relationship with the rotational axis of the machine.
Figure 4:
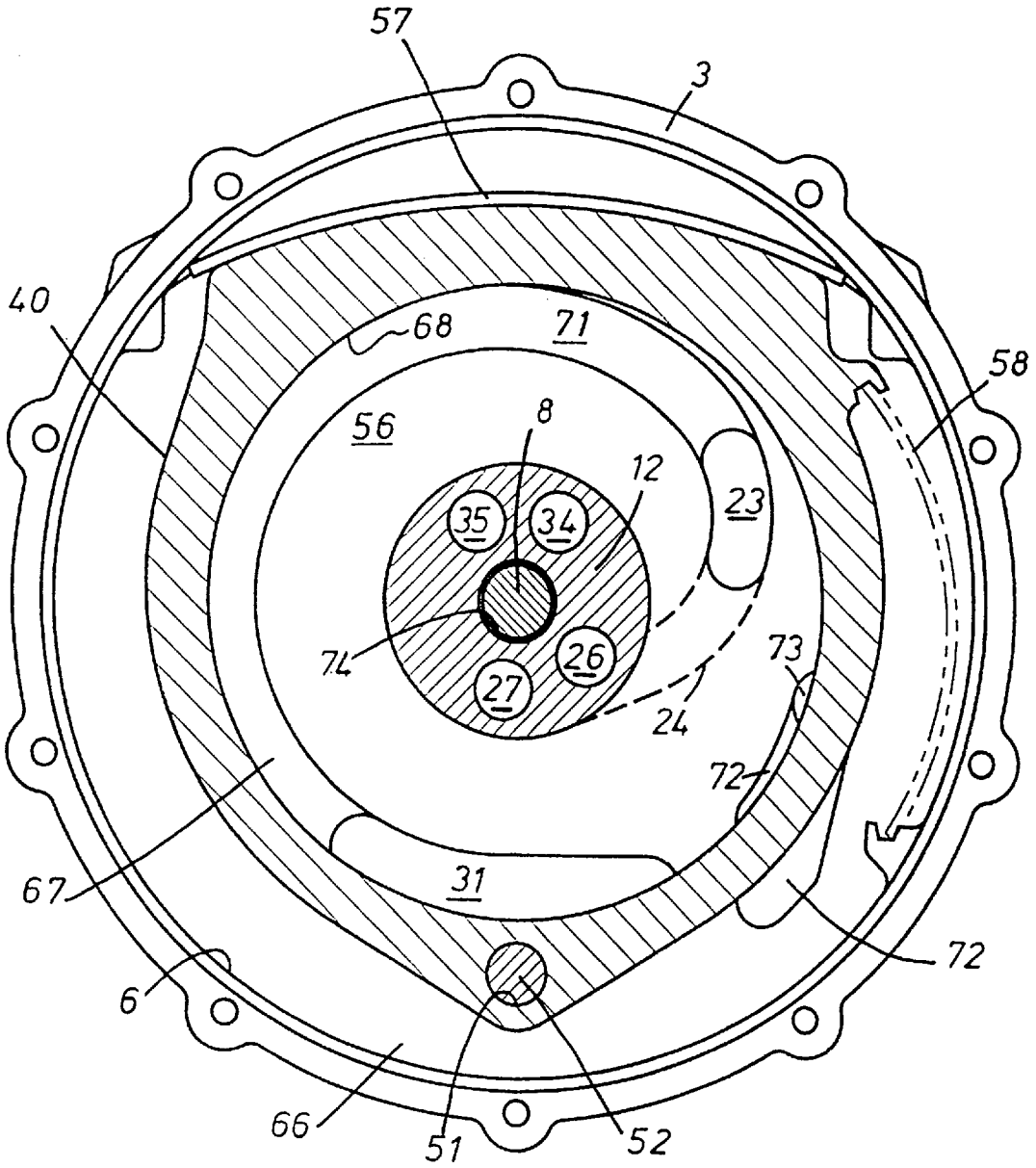
FIG. 4 is an end view on line III—III of FIG. 1. The rotating group comprising the cylinder-barrels and piston/slipper assembly has been removed to better show the arrangement of the ducts and the spiral groove connecting the two ducts together in the sub-chamber. With the track-ring in this position, as shown the third duct is also in direct communication within the sub-chamber.
Figure 5:
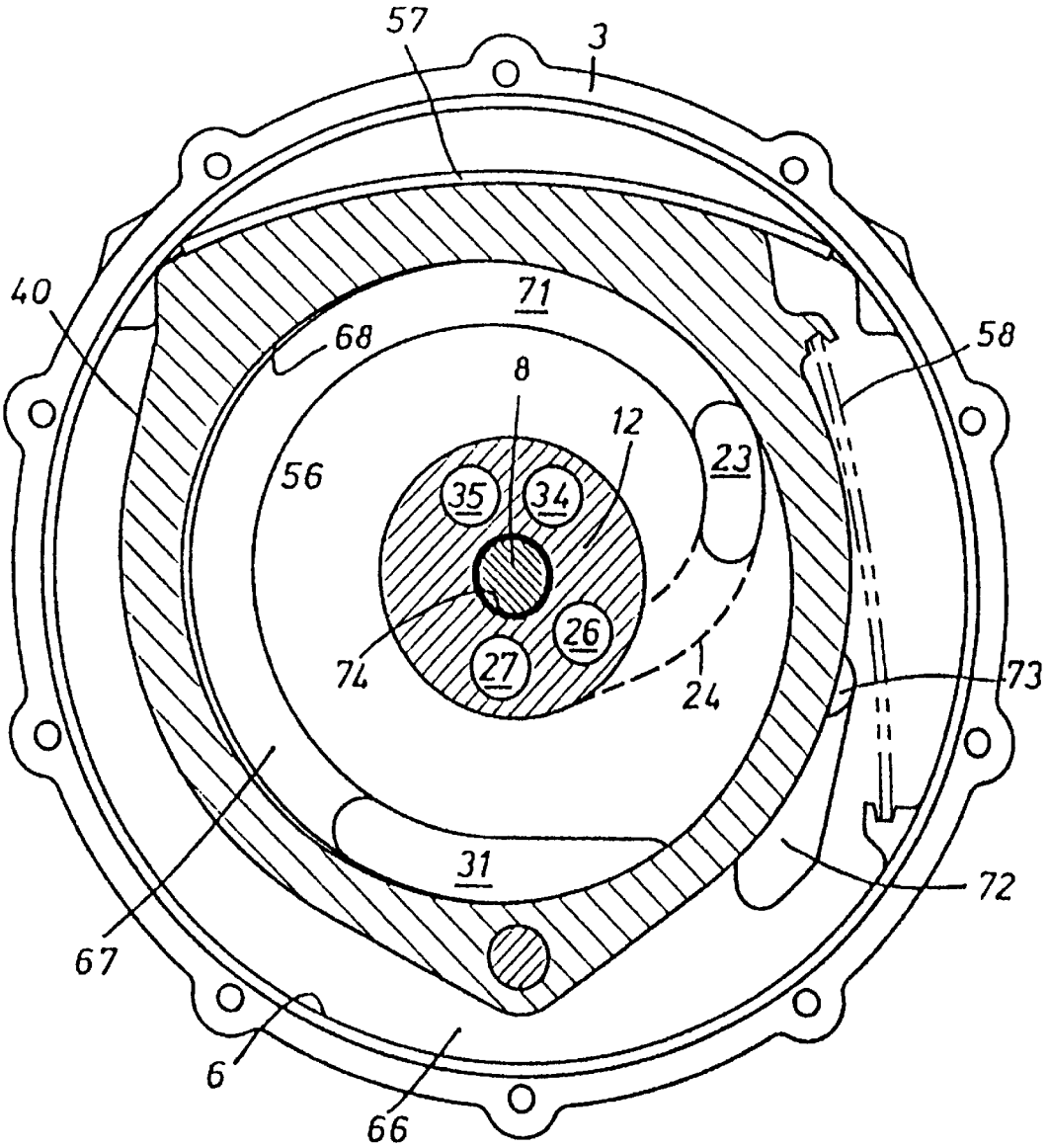
FIG. 5 is an end view on line III—III of FIG. 1. The rotating group comprising the cylinder-barrels and piston/slipper assembly has been removed to better show the arrangement of the ducts and the spiral groove connecting the two ducts together in the sub-chamber. The strut as here depicted in its partially deformed condition which corresponds to the maximum eccentricity of the track-ring with respect to the rotational axis of the machine. With the track-ring in this position, as shown the third duct is essentially closed from direct communication with the sub-chamber.
Figure 6:
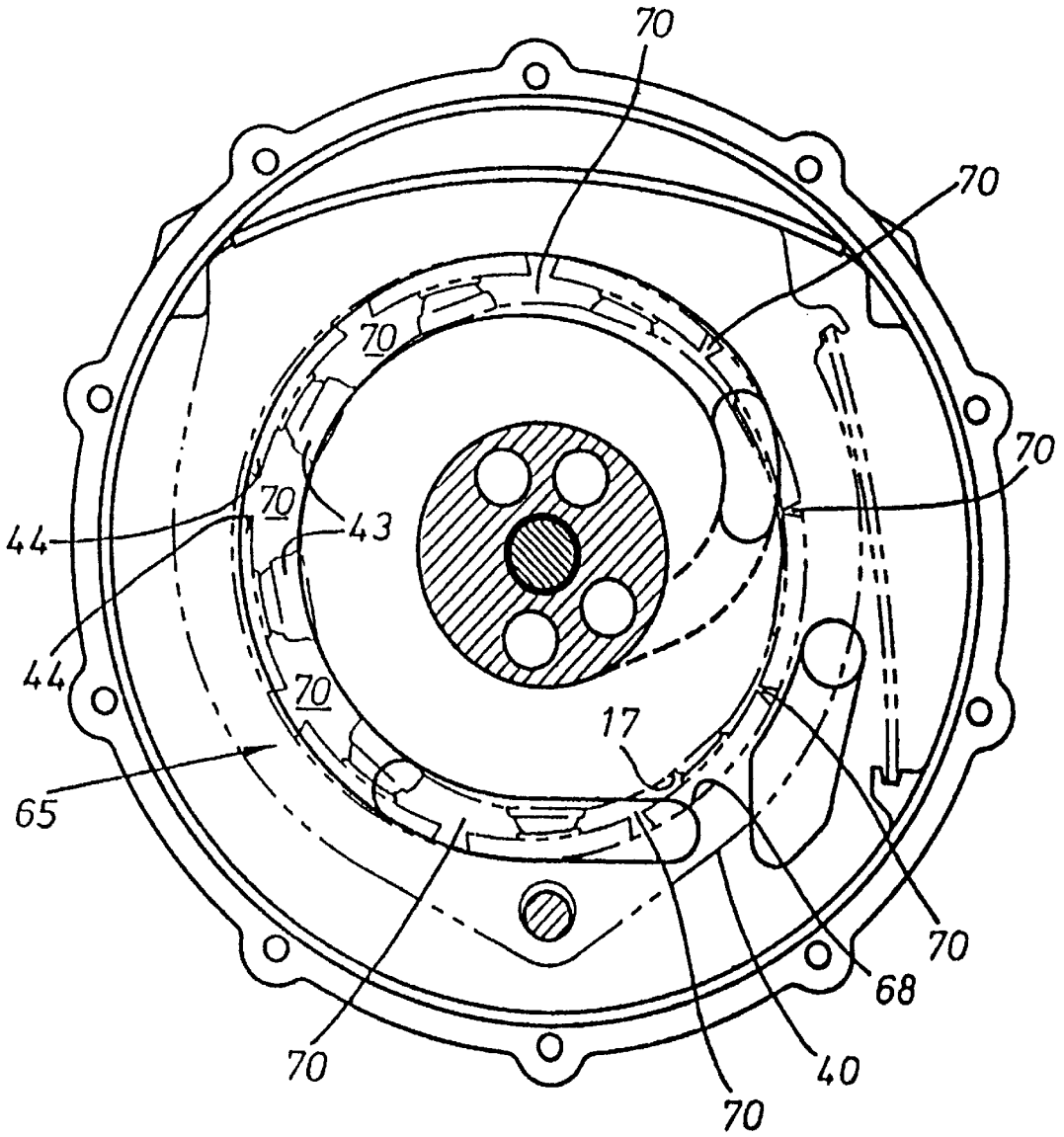
FIG. 6 is essentially the same view as FIG. 5 but where the rotating group is here depicted by phantom lines to better illustrate the relative positions of the pistons and slippers with respect to the ducts and the spiral groove connecting the two ducts together.

Strut-member 58 is anchored at each end in respective grooves 61, 62, and where groove 61 is positioned in radially inwardly finger 63 formed in housing element 3, whereas groove 62 is positioned in an radially outwardly extending protrusion 64 on track-ring 40. Strut member 58 is initially in a partial deformed condition which corresponds to maximum eccentricity of the track-ring 40 relative to the radial position of the cylinder-barrel 17 as depicted in FIGS. 5 & 6. During operation of the machine 1, once the forces on the track-ring 40 from the pistons 43 subjected to pressure reach a predetermined level, the reaction on the track-ring 40 causes the strut-member 58 to deform further with a consequent reduction in the track-ring 40 eccentricity as depicted in FIGS. 3 & 4. However, although a strut-member is here used for purposes of illustrating certain features of the hydrostatic machine, other control means used to change the eccentric position of the track-ring can be incorporated in its place. For example, hydraulic ram or rams, or alternatively, a manually operated linkage arrangement. Furthermore, this invention is also applicable to hydrostatic radial piston machine where the track-ring is arranged to remain in a permanent eccentric position relative to the radial position of the cylinder-barrel.

As seen in FIG. 6, cylinder-barrel 17 containing pistons 43 and their associated slippers 44 can be said to form the rotating-group 65 of the hydrostatic machine 1, such that track-ring 40 with its internally disposed rotating group 65 can be further said to divide the internal chamber 6 into a main chamber denoted by number 66 that surrounds track-ring 40, and a sub-chamber denoted by number 67 which lies generally within the annular operating surface also called track-surface 68 of the track-ring 40. Sub-chamber 67 generally being defined axially by the width of the cylinder-barrel 17 and track-ring 40, and radially by the radial distance between cylinder-barrel 17 and track-ring 40.

The pistons 43 (and slippers 44 when used) that protrude radially outwards from their respective cylinders 41 into sub-chamber 67 act to divide sub-chamber 67 into a numbers of individual cells as denoted by number 70. Therefore, a cell 70 is formed in the space between adjacent pistons 43. The interior housing walls shown as 55, 56 in FIG. 1 disposed to each side of track-ring 40 and rotating group 65 act towards segregating or semi-segregating sub-chamber 67 and the cells 70 within from the main chamber 66.

Ducts 23, 31 are so arranged that the radial position of duct 23 lies slightly closer to the central axis 18 of the hydrostatic machine 1 than the radial position of duct 31. In this embodiment, ducts 23, 31 are shown connected together by means of a shallow spiral groove 71 which is formed on the interior wall 56 of housing element 3. Groove 71 is positioned to lie generally radially inwards of the annular operating surface 68 of track-ring 40 and its presence may on occasion be of use for certain applications.

The fluid distribution means in the form of ducts 23, 31 are therefore provided in housing element 3 are arranged to lie axially adjacent to track-ring 40 and rotating-group 65 and generally radially inwards of the operating track-surface 68 of track-ring 40 in order to be able to communicate with each successive cell 70 as the cells 70 move in sequence around the sub-chamber 67 as the cylinder-barrel 17 rotates.

Although the illustrations show that track-ring 40 can be positioned in close proximity with adjacent housing walls 55, 56 for the creation of semi-segregation of sub-chamber 67 with main chamber 66, the effectiveness of such segregation between sub-chamber 67 and internal chamber 66 may be enhanced if face seal means (not shown) were used between track-ring 40 and the adjacent housing walls 55, 56.

The protruding ends of pistons 43 (and slippers 44 when used) from their respective cylinders 41 operate in a similar manner as an impeller provided with paddles. The pistons 43 protruding from the cylinder-barrel 17 and their associated slippers 44 within sub-chamber 67 thereby act to sweep the fluid circumferentially around the annular space existing inside of the annular track-ring 40. The volume space of cells 70 lying between adjacent pistons 43 expands and contracts during one revolution of the drive-shaft 8 during periods when track-ring 40 is eccentrically positioned with respect to the radial position of cylinder-barrel 17. The action of the cells 70 in association with ducts 23, 31 form the first stage pumping action of the hydrostatic machine 1. Those cells 70 passing over or across ducts 31 during the first one-half revolution of drive-shaft 8 are expanding in volume taking fluid from the duct 31. Once those cells move further around inside the track-ring 40 occurring during the second one-half revolution of drive-shaft 8, the volume of the cells 70 begins to contract and a proportion of the fluid contained therein is deposited into duct 23.

The fluid then passes from duct 23 into passage 24 in the interior of housing element 3 to reach slot 25 and passage 26, 27 in pintle-valve 12. The fluid arriving at arcuate slot 28 can then enter each passing cylinder 41 in turn by means of their associated necked cylinder-ports 42. The volume space in those cylinders 41 which are passing over arcuate-slot 28, this cylinder volume being defined as the space between the necked cylinder-port 42 and the bottom of the piston 43, is increasing as the piston 43, at this phase in the machine operating cycle, is moving in a direction radially outwards of its cylinder 41 as occurs when the track-ring is positioned eccentric to the machine rotational axis 18. During the next phase in the machine cycle, the piston 43 moves back in a direction towards its associated necked cylinder-port 42 and the fluid volume in the cylinder decreases to be expelled through necked cylinder-port 42 to arcuate-slot 33.

The cylinders 41 and the reciprocating pistons 43 contained therein form the second stage pumping action of the hydrostatic machine 1.

FIGS. 4 to 6 depict the inclusion of a third duct numbered 72, as shown located in the interior wall 56 of housing element 3 which can be used in combination with the two other ducts 23, 31. As shown in FIGS. 5 & 6, duct 72 is not in direct communication with sub-chamber 67 during periods when the track-ring 40 is eccentrically positioned with respect to the axis of rotation 18 of the hydrostatic machine 1, as the radial position of track-ring 40 obscures or overlaps it. Thus, with the track-ring 40 in this position, duct 72 is only in communication with the main chamber 66 that surrounds the track-ring 40.

However, once the eccentricity of the track-ring 40 is decreased towards zero, as shown in FIG. 4, the track-ring no-longer obscures duct 72 and duct 72 is then in full communication with sub-chamber 67. At that time, any excess and unwanted flow in the cells 70 which is not required by the second stage, can by-pass the second stage to be expelled through duct 72 and passage 73, this occurring during periods when the second stage is either pumping fluid only at a low rate or not at all. The displaced fluid of the second stage can therefore be used to good effect by transferring unwanted heat in the hydrostatic machine 110 to an external cooler or fluid reservoir.

One of the advantages of a hydrostatic machine having a first stage pump is that the low-pressure passages in the second stage, for instance, passages 26, 27 in the pintle-valve 12 can be smaller in cross-sectional area then would normally be acceptable for a "self-sucking pump". Consequently, more room is thus available within the pintle-valve 12 for the inclusion of central aperture 74, thereby allowing the machine 1 to be fitted with a larger through-shaft than would normally be possible, this being especially important when one or more separate hydrostatic machines are to be attached to the back of the first hydrostatic machine 1.

Note that duct 31 is positioned in housing to be in-phase with arcuate-slot 28 whereas duct 23 is in-phase with arcuate-slot 33.

Figure 7:
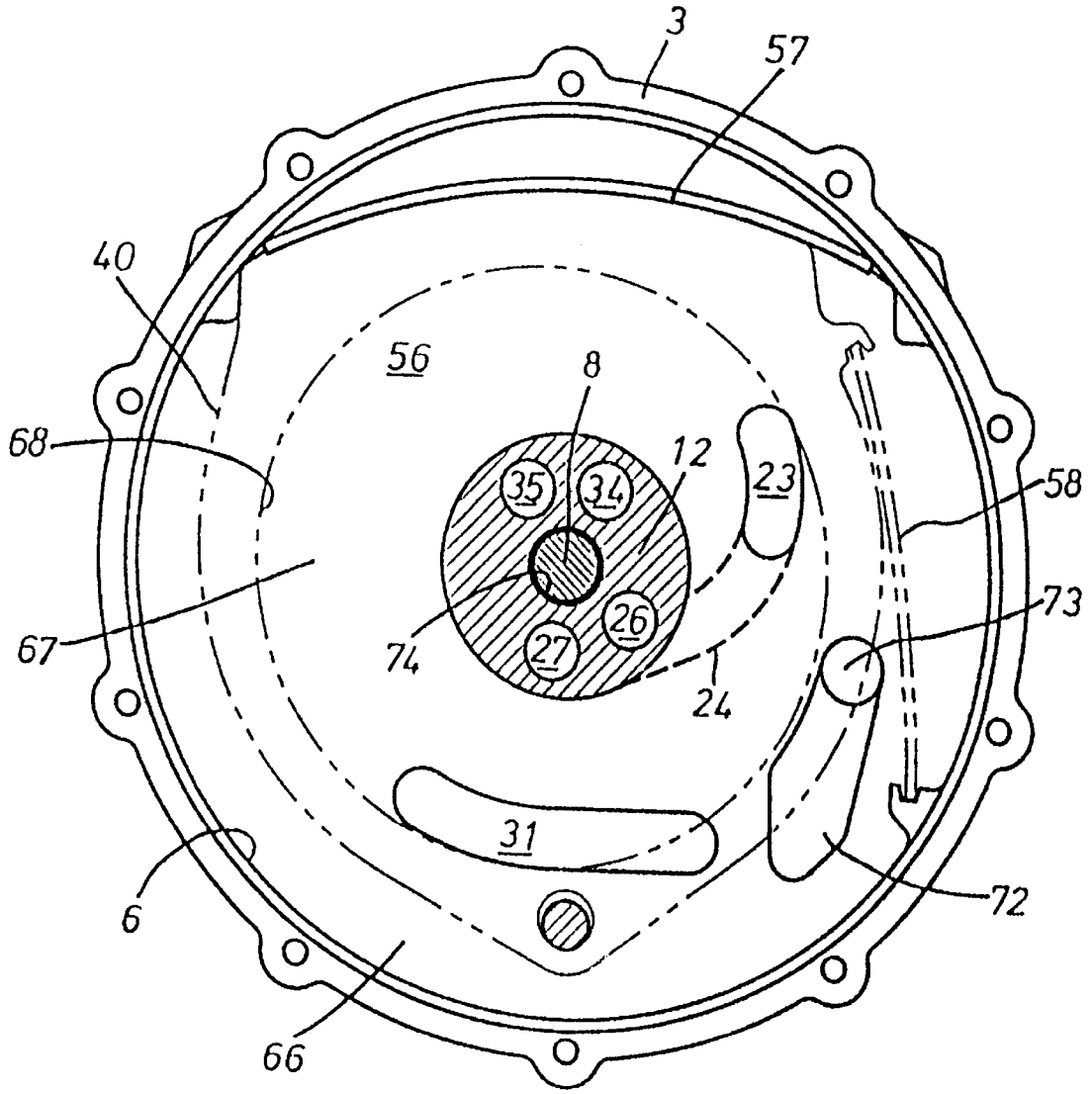
FIG. 7 is an end view on line III—III of FIG. 1 and illustrating the same features as shown in FIG. 5 with the exception that the spiral groove has been omitted. The track-ring and strut are shown by phantom lines.
Figure 8:
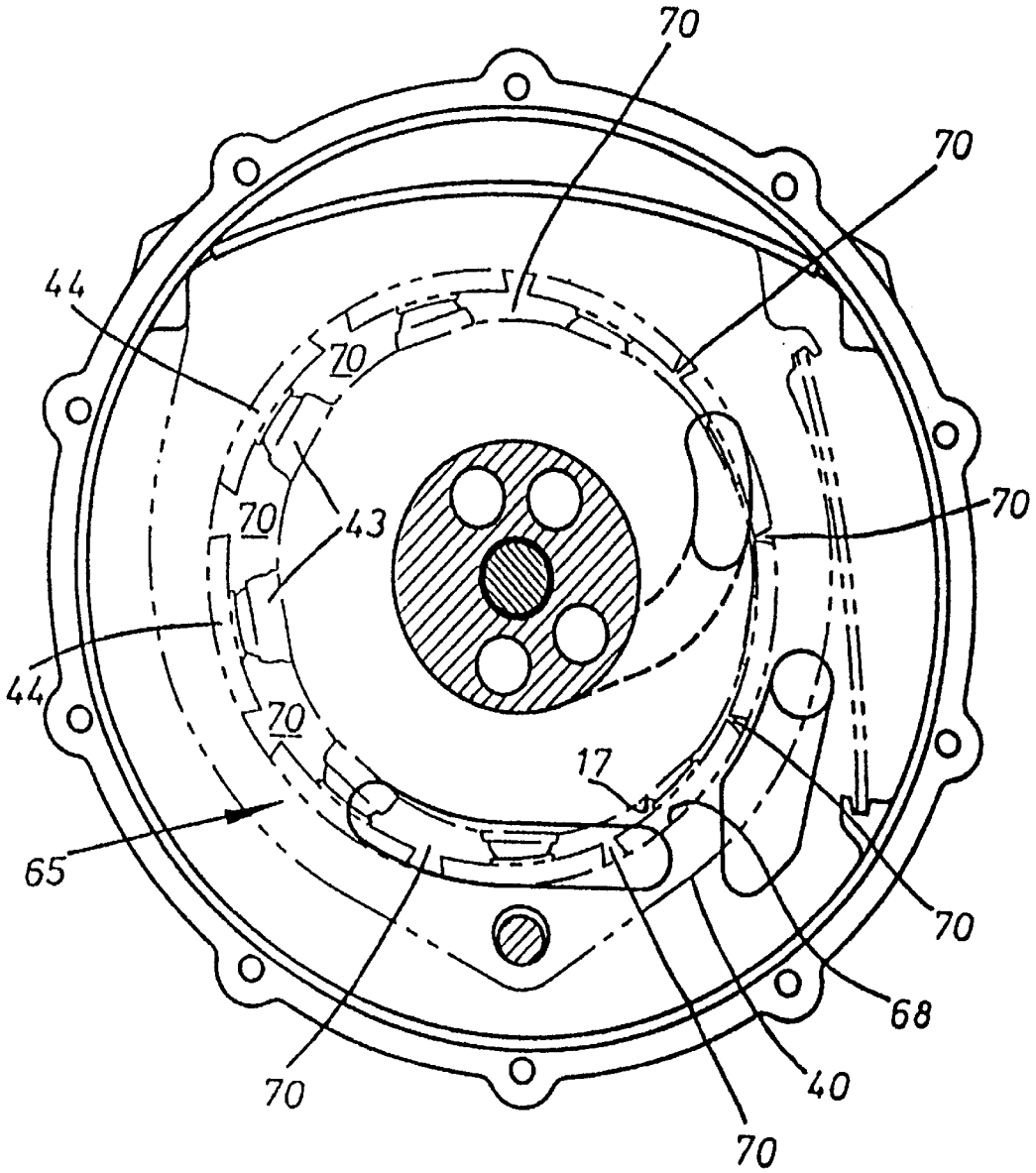
FIG. 8 is essentially the same view as FIG. 7 but where the rotating group is here depicted by phantom lines to better illustrate the relative positions of the pistons and slippers with respect to the ducts.

FIGS. 7 & 8 show a slight modification over the embodiment shown in FIGS. 3 to 6 in that ducts 23, 31 are no-longer directly connected by mean of groove 71 formed in the interior of the housing. Thus in this embodiment, fluid is transferred from duct 31 to duct 23 by the respective cells 70 as they revolve during one full cycle of drive-shaft rotation 8.

Figure 9:
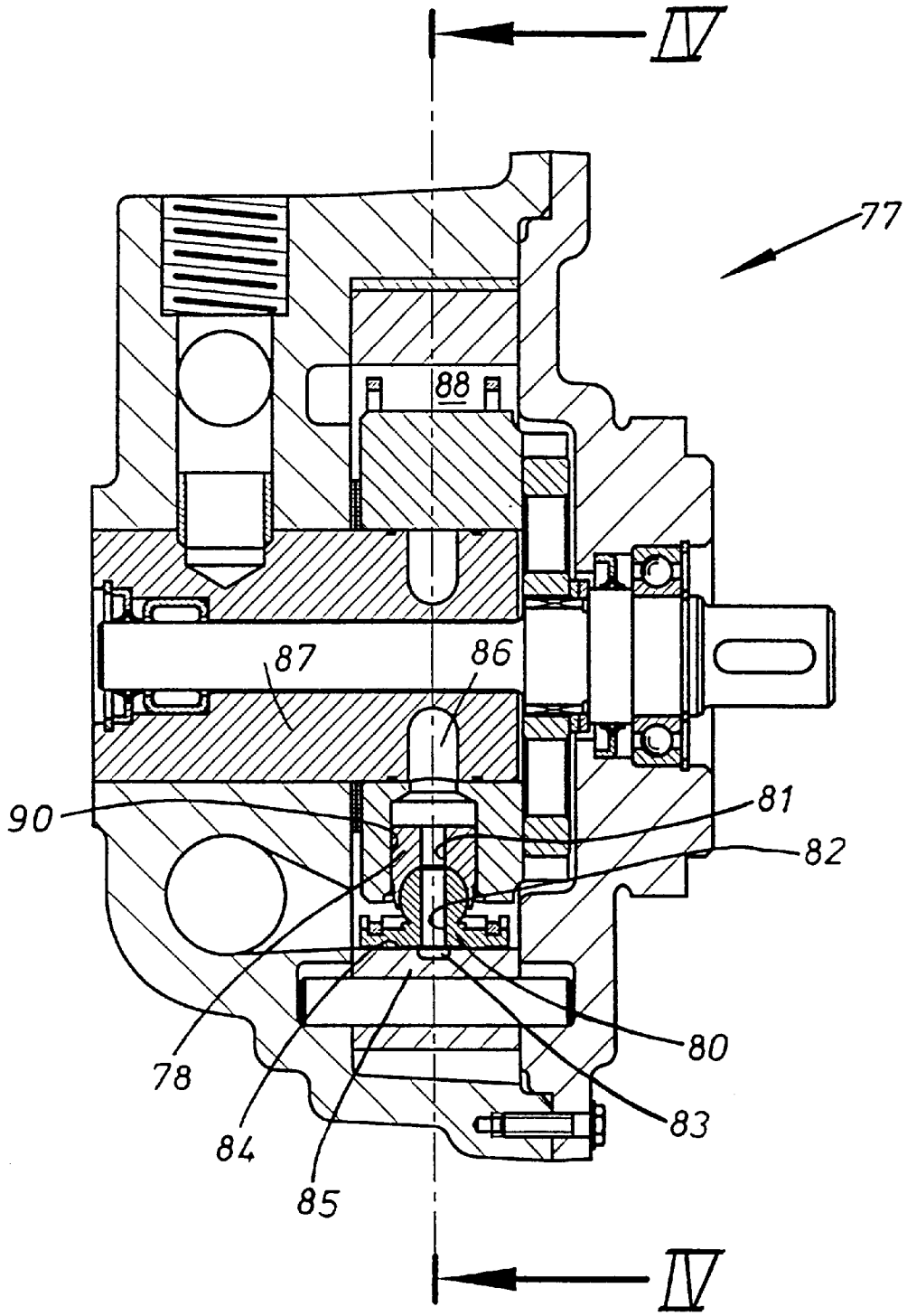
FIG. 9 is a sectional view of the hydrostatic radial piston machine showing a further aspect of the invention.
Figure 10:
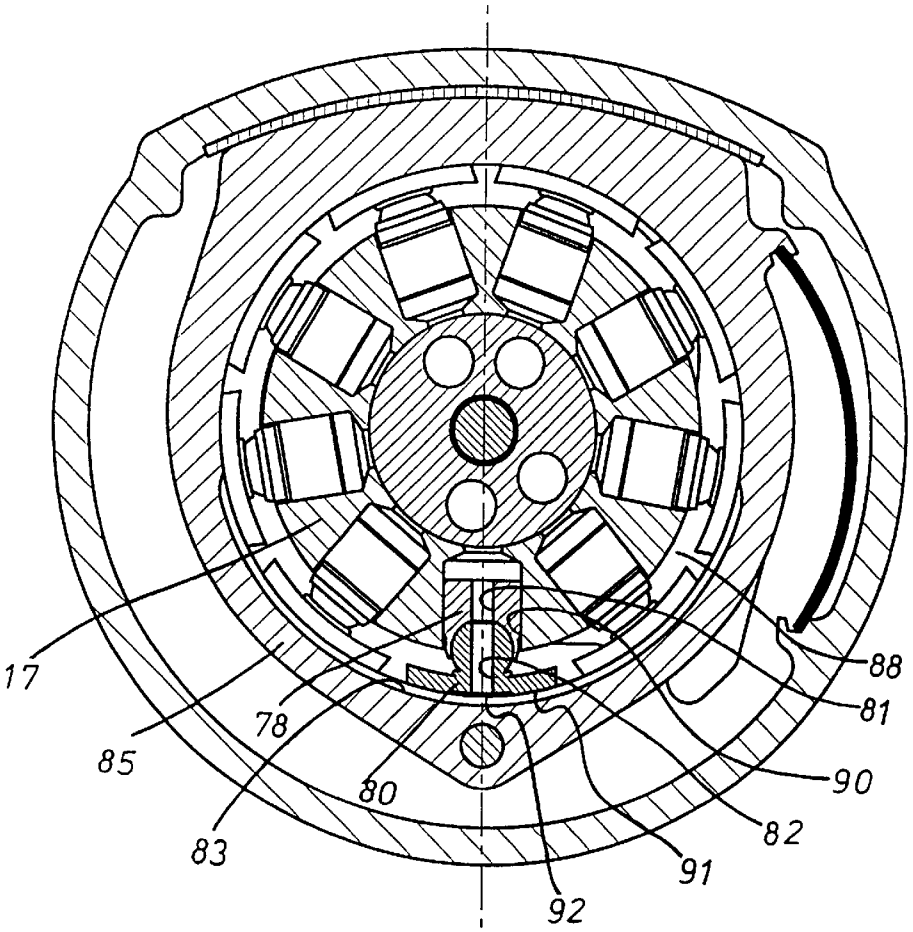
FIG. 10 is a sectional end view on line IV—IV of FIG. 10.

FIGS. 9 & 10 depict a slight modification for the track-ring and piston/slipper assembly that may in some instances provide improved performance for the hydrostatic machine. The hydrostatic machine 77 depicted differs in two main respects. Firstly, the piston 78 and associated slipper 80 are each provided with larger central holes 81, 82 than those holes 47, 48 used in the piston 43 and slipper 44 of the earlier embodiment. Secondly, a shallow discontinuous groove 83 is provided on the inner annular surface 84 of track-ring 85, groove 83 being ideally less that 180 degrees of circumferential length of the track-ring 85 and positioned to be generally in-phase with arcuate-slot 86 in the pintle-valve 87. The purpose of having groove 83 is to allow a proportion of the fluid within sub-chamber 88 to enter into cylinders 90 directly to complement that fluid which arrives into the cylinders 90 in the manner as described for the earlier embodiment.

Fluid in sub-chamber 88 flows into groove 83 and is available to be sucked into the cylinders 90 by means of holes 82, 81 provided in the slipper 80 and piston 78 respectively. Note that fluid sub-chamber 88 can only enter the cylinders 90 in this manner when the slippers 80 are passing over groove 83, such that groove 83 in effect short-circuits the sealing lip 91 on each passing slipper 80 so the fluid can enter recess 92 and hole 82 in slipper 80.

The groove 83 is not circumferentally extended beyond 180 degrees of circumferential length of the track-ring 85 because on the pressure side of the second stage, the slipper hydrostatic bearing must operate in the conventional manner already well established in the art. Thus on the pressure side, the slippers 80 with their recesses 92 and surrounding sealing lips 91 are no-longer passing over groove 83.

Although this feature may be used in combination with the features described earlier, the suction ability in terms of cylinder filing for the hydrostatic machine is hereby improved further which may be advantageous, especially when the machine is to be operated at high speeds in cold environments.

Figure 11:
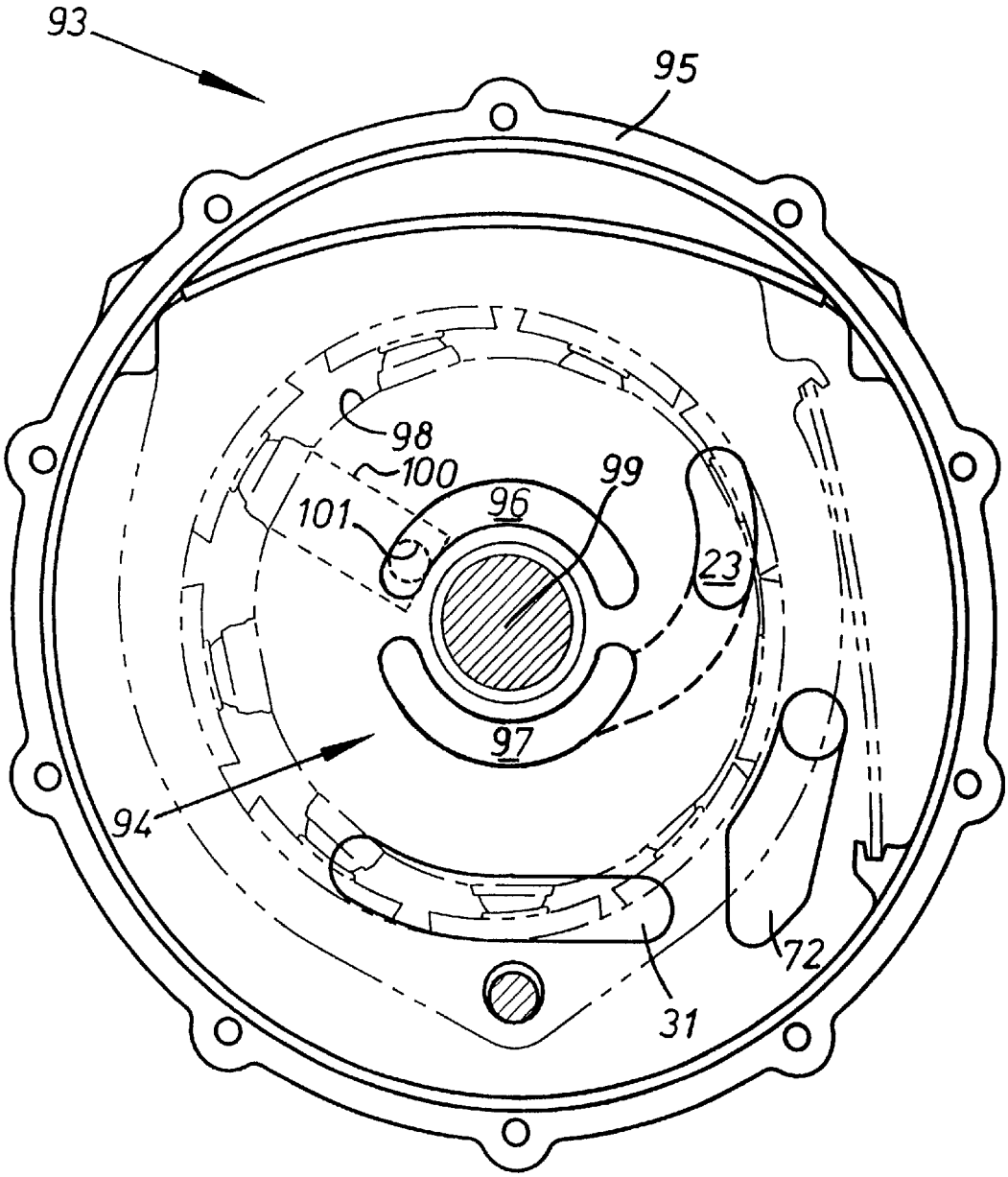
FIG. 11 is an end view of a hydrostatic radial piston machine having an axial distributor face valve in place of the pintle-valve shown in the earlier embodiments.

FIG. 11 depicts a radial piston machine 93 employing an axial distributor face valve 94 in place of the pintle-valve shown and described in the earlier embodiments, and where in this further embodiment, the axial distributor face valve 94 employs at least two arcuate-slots formed in housing member 95, here depicted in the form of generally kidney-shaped channels 96, 97. The channels 96, 97 are arranged to lie radially inwards of ducts 23, 31 on a pitch circle lying inside of the outer diaineter of the cylinder-barrel 98, and radially inwards of ducts 23, 31. Cylinder-barrel 98 is supported and driven by drive-shaft 99 and includes a number of cylinders 100, and where each cylinder 100 is connected through a respective cylinder-port 101 to be able to communicate with channels 96, 97 during the rotation of drive-shaft 99.

OPERATION OF THE MACHINE

The operation of the machine 1 described as the first embodiment is as follows: Rotation of drive-shaft 8 occurs in a clockwise and causes cylinder-barrel 17 to rotate about the pintle-valve 12. If track-ring 40 is set in an eccentric relationship to the central axis 18 about which rotation takes place, outward sliding movement of the pistons 43 in their respective cylinders 41 is obtained, such that fluid from some external source, such as a hydraulic reservoir, is drawn in through the low-pressure fluid admittance passageway 30 in housing element 3. The fluid flows from passageway 30 to duct 31, and where the rotating-group 65 acting as an impeller of the first stage moves the fluid entering the sub-chamber 67 from duct 31 by way of cells 70 so that fluid is transferred by the cells 70 from ducts 31 to duct 23. From here the fluid is directed to the second stage of the machine by flowing through passage 24 and slot 25 and into the longitudinal-passages 26, 27 that lead to arcuate-slot 28. The fluid from there enters each cylinder 41 in turn by way of necked ports 42. As the pistons 43 returns inwards in their respective cylinders 41, the fluid is expelled from the interior of the cylinders 41 via necked port 42 into the opposite arcuate-slot 33 from where it is directed along longitudinal-passages 34, 35 to reach the high-pressure fluid discharge passageway 37 from where it may be piped to service a hydraulic circuit, such as a hydraulic motor. During periods when the track-ring 40 is positioned concentric with respect to the central rotational axis 18 of machine 1, the second stage action of the pistons 43 within cylinders 41 are not displacing fluid. However the first stage action of the rotating group 65 within sub-chamber 67 which is still operative in moving fluid contained within the sub-chamber 67, is able to expel unwanted excess fluid out of the hydrostatic machine 1 by means of the now exposed third duct 72 and its communicating passage 73. Thus when the second stage is either not delivering fluid or only a small amount, heat which accumulates inside the hydrostatic machine 1 can be withdrawn by the action of the second stage which produces a small cooling flow passing the rotating group 65 in sub-chamber 67. This reduces the chances of heat build up damaging the internal elements inside the hydrostatic machine 1 during periods when little flow is required by the high-pressure circuit that the hydrostatic machine supplies.

In accordance with the patent statutes, I have described the principles of construction and operation of my radial piston machine, and while I have endeavoured to set forth the best embodiment thereof, I desire to have it understood that obvious changes may be made within the scope of the following claims without departing from the spirit of my invention.

I claim:

1. A radial piston hydrostatic machine having a first fluid displacement stage and a second fluid displacement stage and comprising a housing defining an internal chamber; a rotatable cylinder-barrel located within said internal chamber and provided with a series of cylinders each containing a piston, the reciprocaticng action of the pistons within said cylinders acting as said second fluid displacement stage; an annular track-ring surrounding said cylinder-barrel and having an track-surface, said track-ring having an solid interior and where said track-surface is uniform in form across its width over the entire circumferential length on which said pistons are operatively connected to, said track-surface defining the outer perimeter of said first displacement stage and said cylinder-barrel defining the inner perimeter of said first displacement stage, said track-ring dividing said internal chamber into a main chamber and a sub-chamber and where the volume space radially outwards of said track-ring is said main chamber and the volume space radially inwards of said track-surface is said sub-chamber; said cylinder-barrel containing said pistons act in unison as a rotating-group of said machine and where fluid distribution by way of first and second ducts provided in said housing and arranged to open axially adjacent said rotating-group and generally radially inwards of said track-surface for communication with said sub-chamber, and where said rotating-group operating within said sub-chamber acts as said first fluid displacement stage for transferring fluid between said first and second ducts to the said second fluid displacement stage.

2. A radial piston hydrostatic machine according to claim 1 wherein the operation and function of said rotating-group for displacing fluid between said first and second ducts is independent of its operation and function for displacing fluid by means of said reciprocating action of the pistons.

3. A radial piston hydrostatic machine according to claim 1 wherein adjacent interior walls of said housing to both sides of said track-ring act to segregate or semi-segregate said sub-chamber from said main chamber.

4. A radial piston hydrostatic machine according to claim 1 wherein said rotating-group transfers fluid circumferentially around said sub-chamber from said first duct to said second duct and where a passageway is provided in said housing to transfer fluid from said second duct to said second fluid displacement stage.

5. A radial piston hydrostatic machine according to claim 4 wherein said sub-chamber is generally defined axially by the axial width of said track-ring and radially by the radial distance between said cylinder-barrel and said track-surface, the volume space between adjacent said pistons defining cells, and wherein the pistons protruding from their respective cylinders form paddles to transfer fluid from said first duct to said second duct.

6. A radial piston hydrostatic machine according to claim 4 wherein said rotating-group is driven by a shaft supported by at least one bearing in said housing, and where an aperture is provided in said pintle-valve to allow the passage of said shaft to pass through said machine, said aperture being positioned in said machine to be radially inwards of said first and second ducts.

7. A radial piston hydrostatic machine according to claim 4 wherein said rotating-group is driven by a shaft supported by at least one bearing in said housing, and where an aperture is provided in said housing to allow the passage of said shaft to pass through said machine, said aperture being positioned in said machine to be radially inwards of said first and second ducts.

8. A radial piston hydrostatic machine according to claim 1 wherein the fluid output of said first fluid displacement stage is in series with said second fluid displacement stage.

9. A radial piston hydrostatic machine according to claim 1 wherein said sub-chamber is generally defined axially by the axial width of said track-ring and radially by the radial distance between said cylinder-barrel and said track-surface, the volume space between adjacent said pistons defining cells, and where rotation of said rotating-group transfers fluid contained within each cell from said first duct to said second duct and where a passageway is provided in said housing to transfer fluid from said second duct to said second fluid displacement stage.

10. A radial piston hydrostatic machine according to claim 9 wherein the position of said track-ring with respect to the radial piston of said cylinder-barrel is altered when said track-ring is eccentrically positioned to said cylinder-barrel, said cells adjacent to each said pistons increase in volume size during one half of a full rotation of said cylinder-barrel to accept fluid from said first duct and decrease in volume size during the remaining half of the full rotation of said cylinder-barrel to expel fluid to said second duct.

11. A radial piston machine according to claim 9 wherein the position of said track-ring with respect to the radial piston of said cylinder-barrel is altered when said track-ring is eccentrically positioned to said cylinder-barrel, the volume space in those cells passing adjacent to said first duct increase in proportion to increasing eccentricity of said track-ring whereas the volume space in those cells passing adjacent to said second duct decrease in proportion to increasing eccentricity of said track-ring.

12. A radial piston hydrostatic machine according to claim 1 wherein the pitch circle diameters of said first and second ducts lie substantially outside the external diameter of said cylinder-barrel and inside the external diameter of said track-ring.

13. A radial piston hydrostatic machine according to claim 1 wherein a slipper is connected to the end of each respective said pistons, said slippers and said pistons protruding radially outwards from said cylinder-barrel in form of an impeller to sweep fluid entering sub-chamber from said first duct circumferentially around said sub-chamber into said second duct.

14. A radial piston hydrostatic machine according to claim 1 wherein a pintle-valve is fixedly and non-rotatably mounted in said housing and extending into said internal chamber to rotatably support said cylinder-barrel, a pair of arcuate-slots formed on the periphery of said pintle-valve and arranged to fluidly connect with said cylinders of said cylinder-barrel, said rotating-group transferring fluid circumferentially around said sub-chamber from said first duct to said second duct and where said second duct is arranged to transfer fluid to a low-pressure longitudinal passage provided in said pintle-valve.

15. A radial piston hydrostatic machine according to claim 14 wherein said first duct is positioned in-phase with one of said pair of arcuate-slots which conducts fluid at low-pressure and where said second duct is positioned to be in-phase with the opposite one of said pair of arcuate-slots which conducts fluid at a higher pressure.

16. A radial piston hydrostatic machine according to claim 1 wherein a drive-shaft is rotatably supported in said housing and extends into said internal chamber to drive said cylinder-barrel, a pair of kidney-shaped channels acting as an axial valve-distributor formed or attached to said housing and arranged to fluidly connect with said cylinders of said cylinder-barrel, said rotating-group transferring fluid circumferentially around said sub-chamber from said first duct to said second duct and where said second duct is arranged to transfer fluid to said second fluid displacement stage.

17. A radial piston hydrostatic machine according to claim 16 wherein said first duct is positioned to be in-phase with that one of said pair of kidney-shaped channels which conducts fluid at low-pressure and where said second duct is positioned in-phase with the opposite one of said pair of kidney-shaped channels which conducts fluid at a higher pressure.

18. A radial piston hydrostatic machine according to claim 12 wherein the pitch circle diameters of said first and second ducts lie substantially outside the external diameter of said cylinder-barrel and inside the external diameter of said track-ring, and where the and the pitch circle diameter of said pair of kidney-shaped channels lie inside the external diameter of said cylinder-barrel.

19. A radial piston hydrostatic machine according to claim 1 wherein the volume of fluid which said rotating-group acting as an impeller displaces between said first and second ducts always exceeds that amount of fluid required by the second fluid displacement stage, and where excess fluid not required by said second fluid displacement stage is released from said sub-chamber to by-pass said second fluid displacement stage.

20. A radial piston hydrostatic machine according to claim 1 wherein a third duct is arranged to lie axially adjacent said track-ring and be permanently exposed with said main chamber, and where the volume of fluid which said rotating-group acting as an impeller displaces between said first and second ducts exceeding that amount of fluid required by the second fluid displacement stage is so arranged such that any excess fluid not required by said second fluid displacement stage is released from said sub-chamber by means of said track-ring exposing said third duct to said sub-chamber.

21. A radial piston hydrostatic machine according to claim 1 wherein a third duct is arranged to lie axially adjacent said track-ring and be permanently exposed with said main chamber, and where the position of said track-ring with respect to the radial piston of said cylinder-barrel is altered such that when said tracking is moves into a concentric relationship with respect to said cylinder-barrel said third duct connects said sub-chamber with said main chamber and a proportion of the fluid displaced by said first displacement stage is released from said sub-chamber to by-pass said second fluid displacement stage.

22. A radial piston hydrostatic machine according to claim 1 wherein a third duct is arranged to lie axially adjacent said track-ring and be permanently exposed with said main chamber, and where the position of said track-ring with respect to the radial piston of said cylinder-barrel is altered such that when said track-ring is concentrically positioned with respect to said cylinder-barrel said third duct connects said sub-chamber with said main chamber and a proportion of the fluid displaced by said first displacement stage is released from said sub-chamber to by-pass said second fluid displacement stage.

23. A hydrostatic radial piston pump having a first fluid displacement stage and a second fluid displacement stage and comprising a housing defining an internal chamber; a rotating-unit located within said internal chamber comprising a cylinder-barrel with several cylinders each containing a piston, said cylinders with their pistons forming the second fluid displacement stage; a track-ring with an track-surface co-operating with said pistons, said pistons forming with said chamber surrounded by said track-ring the said first fluid displacement stage; said housing having a fluid inlet and a fluid outlet, and first and second ducts are provided for connecting said chamber with said fluid inlet on the one hand and with said cylinders within said cylinder-barrel on the other hand, characterised in that the first duct and the second duct are aranged in said housing axially adjacent said rotating-unit and generally radially inwards of said track-surface of said track-ring and in communication with said chamber as said first fluid displacement stage for transferring fluid between said first and second ducts to said second fluid displacement stage.

24. A radial piston pump according to claim 23 characterized in that both said ducts are arranged in a side wall of said housing.

25. A radial piston pump according to claim 24 characterized in that the two said ducts are inconnected by a spiral groove in the housing side wall.

26. A radial piston pump according to claim 23 characterized in that the adjacent inner walls of said housing to both sides of said track-ring segregate or semi-segregate said chamber from the space radially outwards of said track-ring.

27. A radial piston pump according to claim 23 characterized in that the spaces between adjacent said pistons form cells within which the fluid contained therein is transferred from the first to the second duct during rotation of said rotating-unit.

28. A radial piston pump according to claim 27 characterized in that said first and second ducts lie substantially radially outside said cylinder-barrel.

29. A radial piston pump according to claim 28 wherein a pintle-valve is provided on which said cylinder-barrel is rotatably supported and which had on its periphery a low-pressure arcuate slot and a high-pressure arcuate slot which alternatively co-operate with said cylinders of said cylinder-barrel, characterized in that said second duct is in communication with said low-pressure arcuate slot and that said first duct is in phase with said low-pressure arcuate slot and said second duct is in phase with said high-pressure arcuate slot.

30. A radial piston pump according to claim 28 wherein an axial face valve with kidney-shaped low pressure and high-pressure ports are provided and which alternativey co-operate with said cylinders, characterized in that said second duct is in communication with said low-pressure port and that said first duct is in phase with said low-pressure port and said second duct is in phase with said high-pressure port.

31. A radial piston pump according to claim 28 characterized in that an aperture is provided to support and allow the passage of a shaft through the pump.

32. A radial piston pump according to claim 23 characterized in that the displacement of said first displacement stage always exceeds the amount of fluid required by said second displacement stage, and where said track-ring can be moved relative to said cylinder-barrel, characterized in that a third duct is provided for releasing excess fluid displaced by said first fluid displacement stage, said third duct being located such it is separate from said chamber by said track-ring when said track-ring is in an eccentric position to said cylinder-barrel, and is released from said chamber when said track-ring is concentric to said cylinder-barrel.

33. A radial piston pump according to claim 23 characterized in that the displacement of said first displacement stage always exceeds the amount of fluid required by said second displacement stage, and where said track-ring can be moved relative to said cylinder-barrel, characterized in that a third duct is provided for releasing excess fluid displaced by said first fluid displacement stage, said third duct being positioned with respect to the position of said track-ring such that its availability for communication with said chamber increases as said track-ring is moved towards a concentric relationship with said cylinder-barrel.

* * * * *